US010643589B1

(12) United States Patent
McKee et al.

(10) Patent No.: US 10,643,589 B1
(45) Date of Patent: May 5, 2020

(54) HI-HAT PERCUSSION INSTRUMENT

(71) Applicants: Michael Neal McKee, Raleigh, NC (US); Daniel Young, Nashville, TN (US)

(72) Inventors: Michael N. McKee, Raleigh, NC (US); Daniel Robert Young, Nashville, TN (US)

( * ) Notice: Subject to any disclaimer, the term of this patent is extended or adjusted under 35 U.S.C. 154(b) by 0 days.

(21) Appl. No.: 16/200,329

(22) Filed: Nov. 26, 2018

Related U.S. Application Data

(60) Provisional application No. 62/591,940, filed on Nov. 29, 2017.

(51) Int. Cl.
*G10D 13/06* (2006.01)
*G10D 13/065* (2020.01)

(52) U.S. Cl.
CPC ..... *G10D 13/065* (2013.01)

(58) Field of Classification Search
CPC ..... G10D 13/065
USPC ..... 84/422.3
See application file for complete search history.

(56) References Cited

U.S. PATENT DOCUMENTS 1,596,495 A * 8/1926 La Londe ..... G10D 13/06 84/402
3,009,379 A * 11/1961 Thomas ..... G10D 13/06 84/402
3,141,370 A * 7/1964 Ross ..... G10D 13/06 84/402
3,167,995 A * 2/1965 La Londe ..... G10D 13/065 84/421
3,185,014 A * 5/1965 Ross ..... G10D 13/065 84/422.3
3,677,127 A * 7/1972 Garven ..... G10D 13/06 84/402
3,705,528 A * 12/1972 Cordes ..... G10D 13/06 84/421
3,742,810 A * 7/1973 Crigger ..... G10D 13/065 84/422.3
4,177,709 A * 12/1979 Adams ..... G10D 13/065 84/402
4,426,906 A * 1/1984 Otto ..... G10D 13/06 84/402
4,911,056 A * 3/1990 Belli ..... G10D 13/06 84/402

(Continued)

FOREIGN PATENT DOCUMENTS

CN 203520849 U * 4/2014

*Primary Examiner* — David S Warren
*Assistant Examiner* — Christina M Schreiber

(57) ABSTRACT

An instrument modeled after a hi hat hi-hat consisting of wood, metal (or other material) and linked material, creating a complex sound effect when closed together, and an "808" (i.e. Roland "808" or similar) snare drum sound when struck with drumstick is disclosed. This invention allows drummers to create complex sounds using the hi-hat pedal (or other mounting device), to lower the Top Hi-hat toward the Bottom Hi-hat and cause the linked material to connect with the "bottom hi-hat." The claimed device also replaces the standard electronic pad (such as but not limited to the Roland SPDS sampler pad) that recreated the famous "808" (i.e. Roland "808" or similar) handclap sound. Variations of the invention is meant to be used either alongside the traditional metal hi-hat or in lieu of the traditional metal hi-hat.

8 Claims, 5 Drawing Sheets

(56) References Cited

U.S. PATENT DOCUMENTS 5,052,262 A * 10/1991 Havens ..... G10D 13/065 84/421
5,063,819 A * 11/1991 Hoshino ..... G10D 13/065 84/422.3
5,218,151 A * 6/1993 Kurosaki ..... G10D 13/065 248/125.2
5,267,500 A * 12/1993 Lombardi ..... G10D 13/065 84/402
5,915,289 A * 6/1999 Hart ..... G10H 3/143 84/402
5,959,227 A * 9/1999 Shapiro ..... G10D 13/06 84/411 M
5,986,195 A * 11/1999 Liao ..... G10D 13/06 84/402
6,054,645 A * 4/2000 Gauger ..... G10D 13/065 84/411 R
6,617,501 B2 * 9/2003 Kaufmann ..... G10D 13/06 84/422.2
6,720,491 B1 * 4/2004 Kroncke ..... G10D 13/06 84/422.3
8,865,986 B1 * 10/2014 Twyford ..... G10D 13/06 84/402
9,053,693 B1 * 6/2015 Wei ..... G10H 3/00
9,263,012 B2 * 2/2016 Truchsess ..... G10D 13/06
9,390,694 B2 * 7/2016 Berlinger ..... G10D 13/029
9,659,550 B2 * 5/2017 Jasperson ..... G10D 13/065
9,990,909 B1 * 6/2018 Azaceta ..... G10D 13/06
10,013,960 B1 * 7/2018 Wish ..... G10D 13/02
10,262,636 B2 * 4/2019 Sutton ..... G10D 13/065
2005/0155483 A1 * 7/2005 Anderson ..... G10D 13/06 84/422.3
2012/0118130 A1 * 5/2012 Field ..... G10H 3/146 84/730
2012/0144980 A1 * 6/2012 Roderick ..... G10H 3/143 84/723
2012/0186415 A1 * 7/2012 Taninbaum ..... G10D 13/06 84/418
2014/0116227 A1 * 5/2014 Yoshino ..... G10D 13/06 84/402
2014/0260895 A1 * 9/2014 Krol ..... G10D 13/02 84/418
2016/0372094 A1 * 12/2016 Jasperson ..... G10D 13/065
2018/0350332 A1 * 12/2018 Sutton ..... G10D 13/065
2019/0197998 A1 * 6/2019 Yoshino ..... G10D 13/06

* cited by examiner

HI-HAT PERCUSSION INSTRUMENT

CROSS REFERENCE TO RELATED APPLICATIONS

This application claims the benefit of U.S. provisional application Ser. No. 62/591,940 filed on Nov. 29, 2017, the contents which are herein incorporated by reference.

BACKGROUND OF THE INVENTION

The invention relates to a hi-hat percussion instrument and more particularly, to an improved hi-hat percussion instrument having a unique sound when closed together or when struck with a drumstick. The Top or Bottom hi-hat consisting of any one of or a combination of wood, metal (or other material) and linked material such as chain links, creating a complex sound effect when closed together, and having an "808" (i.e. Roland "808" or similar) snare drum sound when struck with a drumstick.

Hi-hat percussion instruments comprise a pairing of two hi-hats (herein, "Top Hi-hat" and "Bottom Hi-Hat") that come together to make a clashing hi-hat sound by action of a foot pedal. Most often, the Top hi-hat is connected to the foot pedal by a rod passing through the treadle stand with spring biasing in the stand adjacent to pedal to bias the Top hi-hat up and away from the fixed Bottom hi-hat. U.S. Pat. Nos. 3,167,995; 3,742,810; 5,052,262, 5,063,819; 5,218, 151; 5,267,500 and 6,054,645, all herein incorporated by reference, demonstrate variant examples of hi-hats which all may be modified according to the invention as described herein, wherein various embodiments are offered that provide for enhanced or modified hi-hat sound effects.

SUMMARY OF THE INVENTION

The embodiments herein, provide an improved hi-hat assembly that can be utilized to enhance or modify said hi-hat's sound. Traditional hi-hats are clean and one-dimensional in sound, and no currently available hi-hat can provide an electronic handclap "808" (i.e. Roland "808" and others) or crunching chain sound when closed. No currently available hi-hats allow for "add-ons" in combination with the invention as described herein such as, but not limited to, shells, metal, plastic jingles, or other accessories that enhance or change the desired sound effect. The embodiments as described herein, allows drummers to create complex sounds using the hi-hat pedal (or other mounting device), to lower the Top hi-hat toward the Bottom hi-hat and cause the linked material to connect with the Bottom hi-hat. Embodiments herein, also replaces the standard electronic pad such as but not limited to the Roland SPDS sampler pad that recreated the famous "808" (i.e. Roland "808" or similar) handclap sound. Embodiments herein are meant to be used either alongside the traditional metal hi-hat or in lieu of the traditional metal hi-hat.

Other objects and advantages will become apparent upon a reading of the specification, claims and a review of the figures.

DETAILED DESCRIPTION OF THE INVENTION

Figure 4:
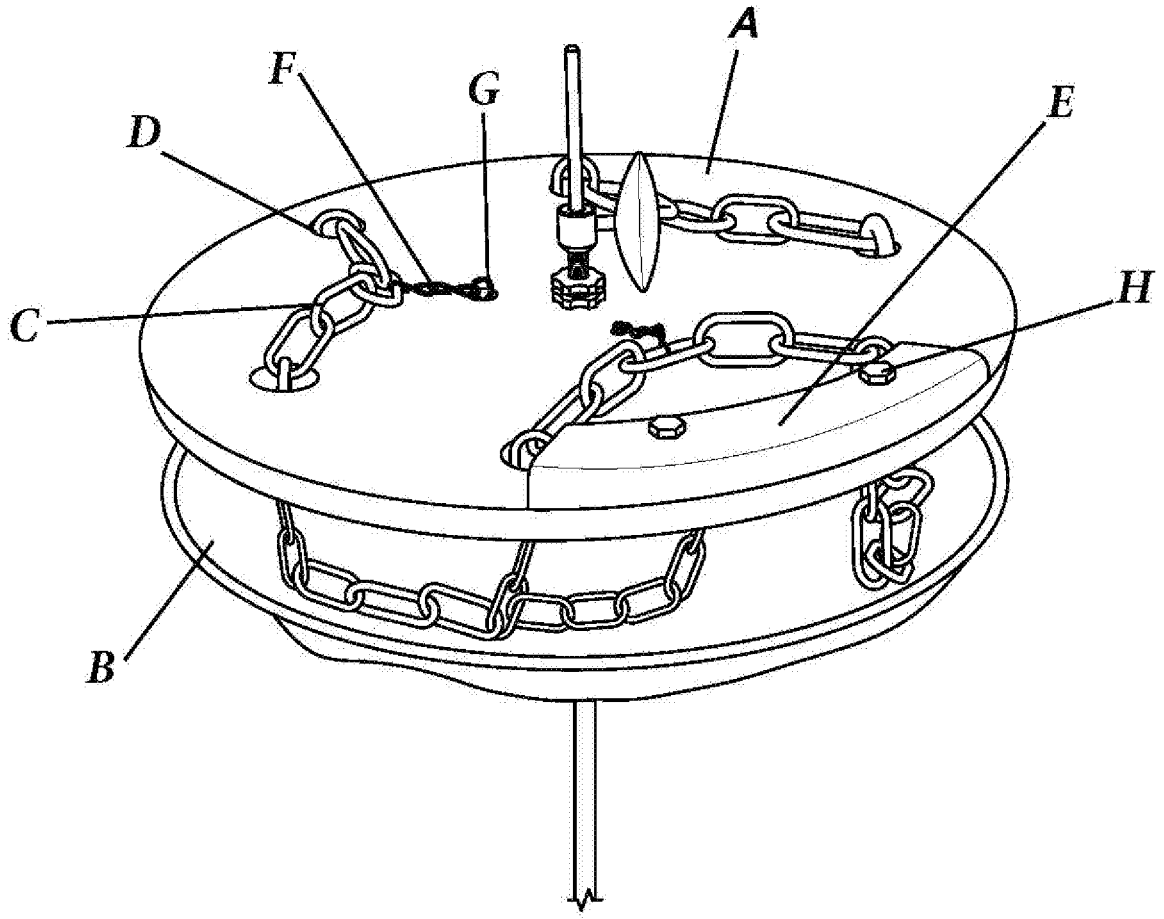
FIG. 4 is a side view of the modified hi-hat opened.
Figure 5:
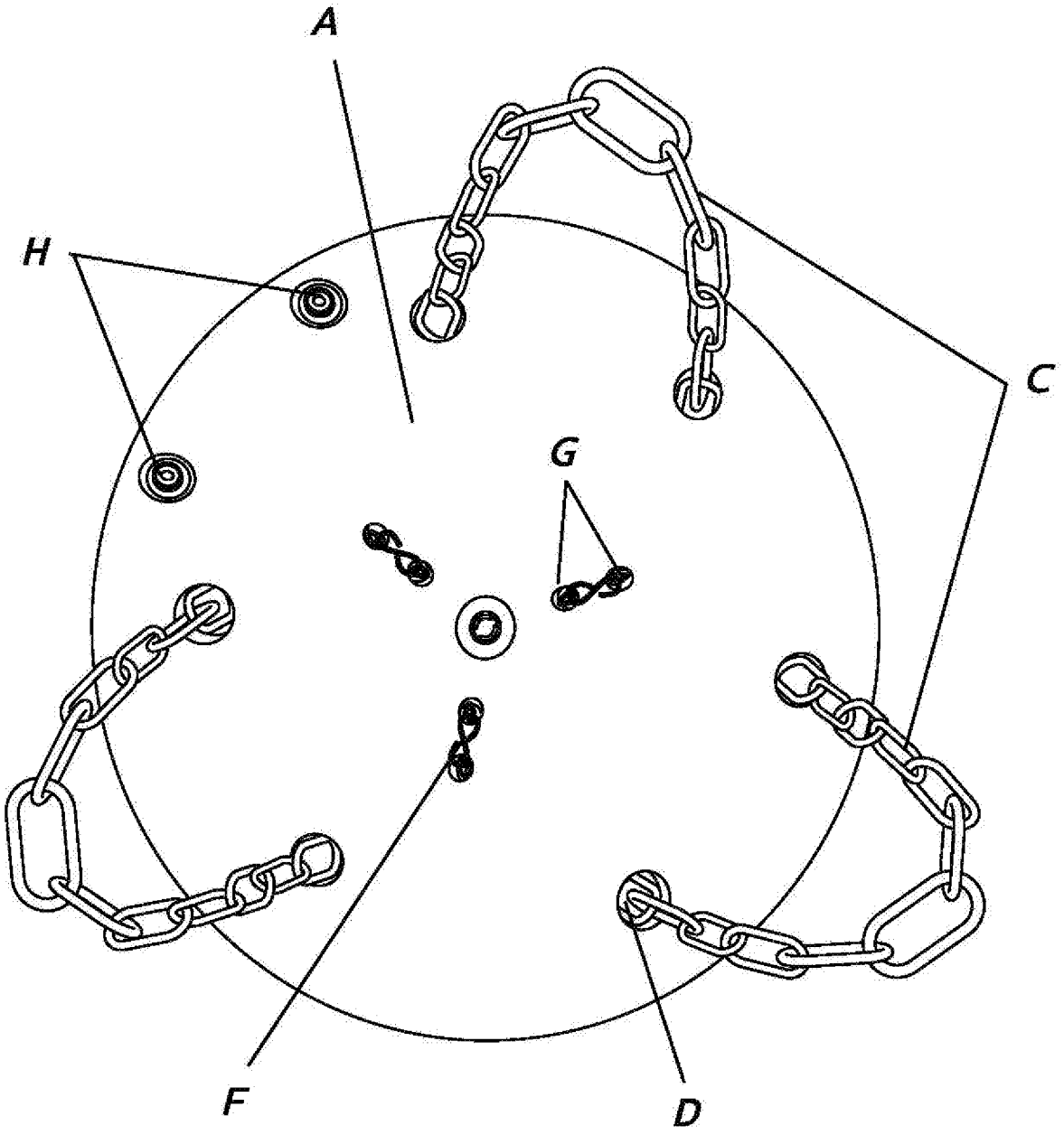
FIG. 5 is a view of the underside of the Top Hi-hat with chain assembly and strike plate attachment.

Referring to the figures (i.e. FIGS. 1-5), the components of the invention may be reviewed. As stated before a hi-hat comprises a "Top Hi-hat" (marked "A" in FIGS. 1 and 3-5) and a "Bottom Hi-hat" (marked as "B" in FIGS. 1, 2, and 4). In some embodiments of the invention the Top Hi-hat is made of for example, a metal such as steel, aluminum, cast alloy, tin; or wood such as ½ inch plywood or composite board; or using any commercial hi-hat available. Further the Top Hi-hat could be of any reasonable size or any commercially available size for hi-hat hi-hats (e.g. 10-20 inch Hi-hat cymbals). In addition, it is understood that the various modifications could be applied such as variations of thickness, machine hammering of the edges, adding grooves to the surface of or any other modification as known by those skilled in the art.

Figure 1:
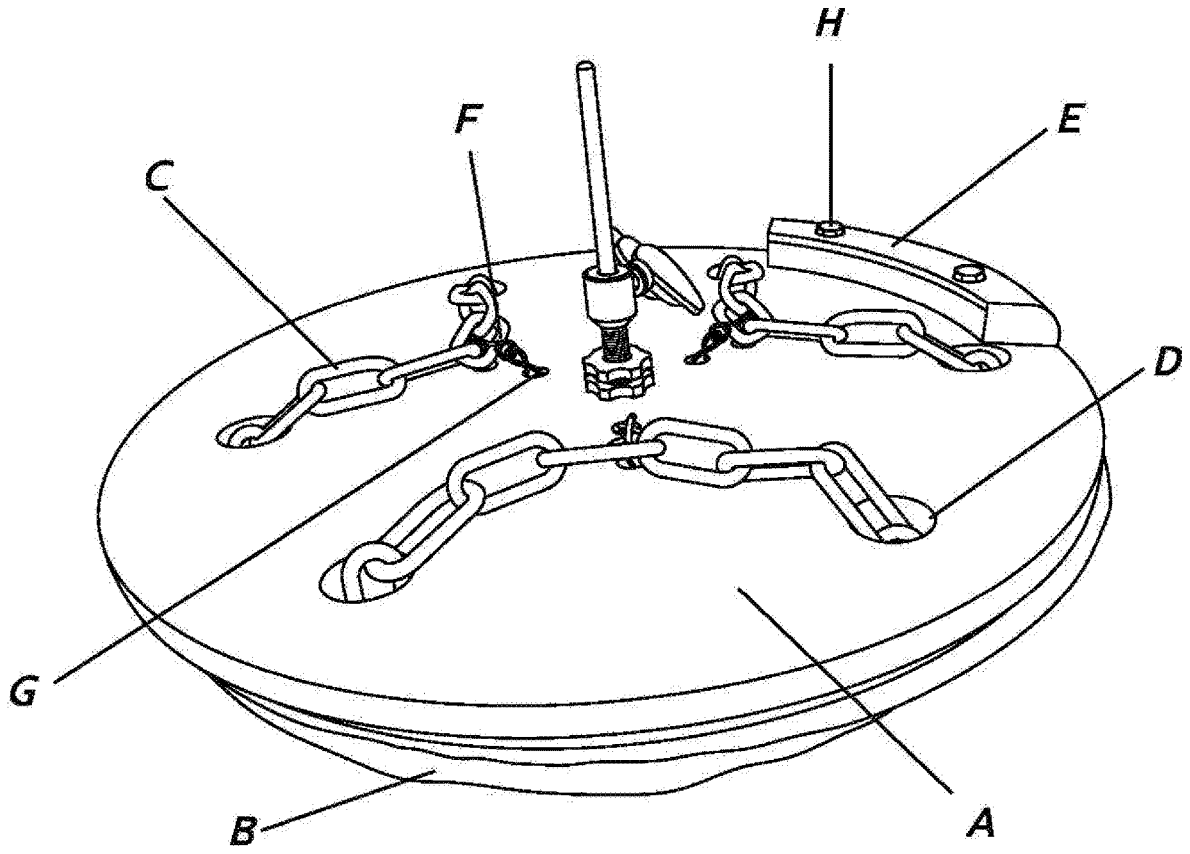
FIG. 1 is a side elevation of the hi-hat closed showing the Top Hi-hat, Bottom Hi-hat, impact plate and chain assembly.

The "Chain Assembly" comprises a "Primary Chain" (marked as "C" in FIGS. 1 and 3-5) and a "Secondary Chain" (marked as "F" in FIGS. 1 and 3-5). The Secondary Chain is connected to the Primary Chain as shown in FIGS. 1 and 3-5. In some embodiments the Primary chain is ¼ inch chain however, the Primary Chain can be of various sizes to give various sound effects. Further, other materials such as glass, shells, bells, or plastic can be attached to the Primary Chain for a modified sound effect. The Secondary Chain is generally comprised of smaller link diameter as compared to the Primary chain. In one embodiment, the Secondary Chain is a chain such as Everbilt #14 Black Jack Chain or an equivalent. In other embodiments, the Secondary chain can be rope, rubber straps or bands, or some other equivalent to hold the Primary Chain in place on the Top Hi-Hat as shown in FIG. 1. In other embodiments, the Primary Chain is attached to the Top Hi-hat by adhering or attaching the Primary chain directly to the Top hi-hat (i.e. comprising no Secondary chain) by epoxy or weld, for example. In some embodiments the invention has 1 Chain Assembly. In other embodiments the invention has 2 Chain Assemblies. In a preferred embodiment, the invention comprises 3 Chain Assemblies as shown in FIGS. 1 and 3-5. Chain assemblies can comprise a chain length connected with a ⅛ inch or various size chain connector(s) or equivalents.

Figure 2:
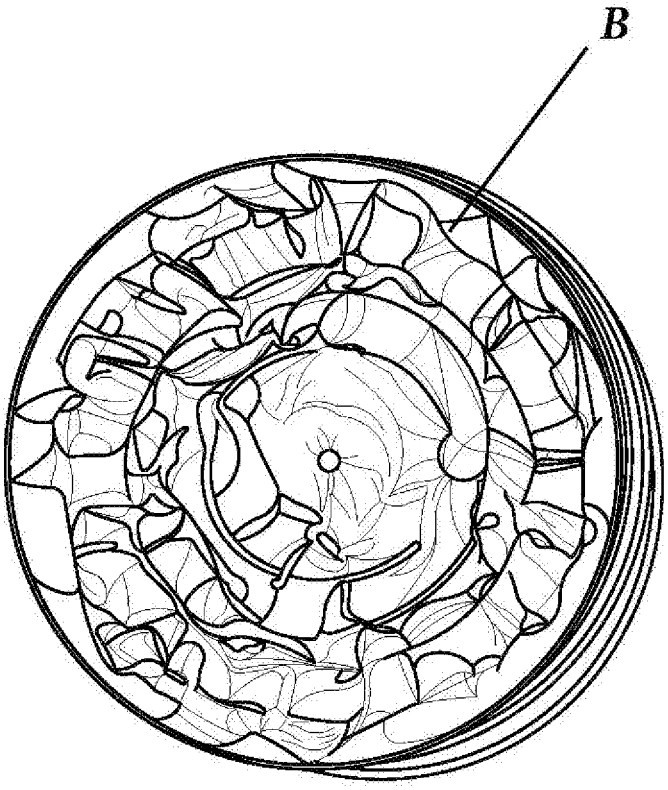
FIG. 2 is a top view of the Bottom Hi-hat having hammered indentions and/or an uneven surface.
Figure 3:
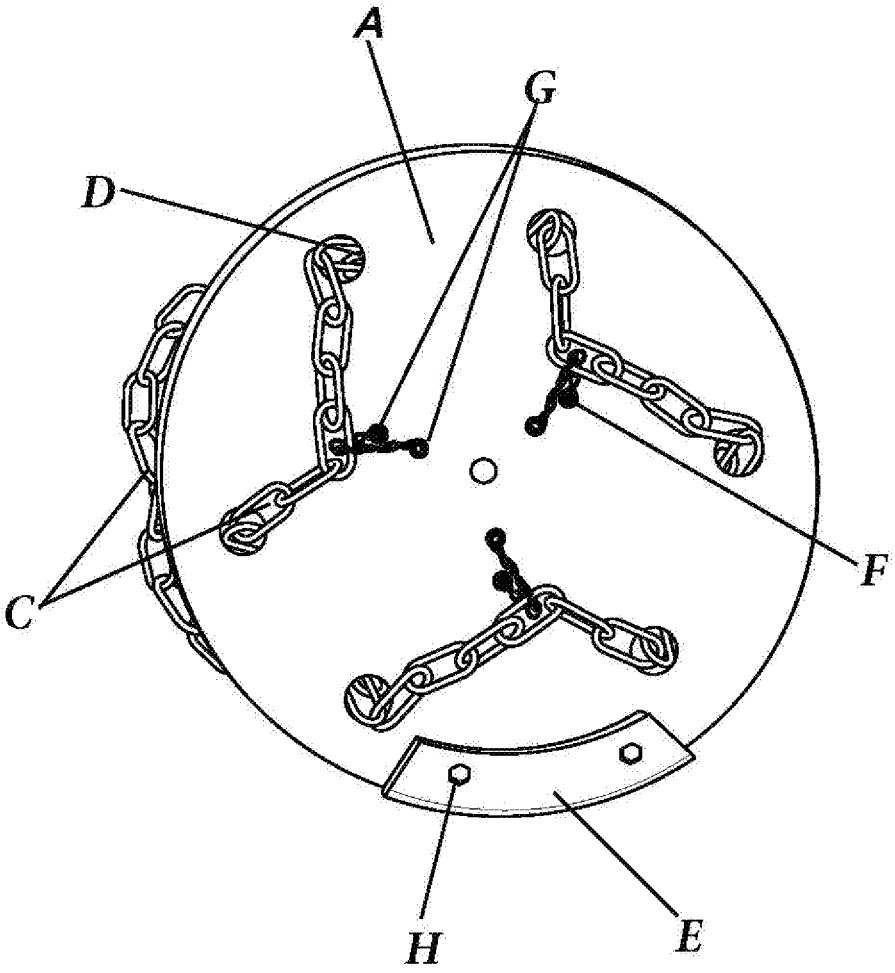
FIG. 3 is a view of the top side of the Top Hi-hat with impact plate and chain assembly.

The "Bottom Hi-hat", in some embodiments is 14 inches in diameter and comprised of metal such as tin, metal alloy, or aluminum. In some embodiments the Bottom Hi-hat is a 14-inch 6-gallon trash can lid or equivalent (e.g. Ace Hardware SKU #7205834) with handle removed and hammered into shape with a ¼ inch hole drilled in the center. In another embodiment, the Bottom Hi-hat surface is hammered or dimpled as shown in FIG. 2. to give a varied sound quality.

The "Impact Plate" (marked as E in FIGS. 1, 3 and 4) is attached to the Top Hi-hat A by two hex bolts (e.g. ¼ inch hex bolts) (labeled H in FIGS. 1, 3, 4 and 5. The "impact Plate" can be made of wood, composite decking, metal, or plastic. In a preferred embodiment the Impact Plate is comprised of composite deck board (e.g. 0.67-inches×11.25-in). In a preferred embodiment the impact plate is attached by two 1¼ inch hex bolts with 2 washers and 2 lock nuts to the Top Hi-hat as shown in, for example, FIG. 1.

As stated above, ordinary hi-hats are very one dimensional and have a simple and clean sound when closed. They do not have a hand-clapping sound when struck with a drumstick, or a crunchy or complex chain dropping sound when closed. The invention claimed herein provides embodiments that offer variations of sound effects not offered by currently available hi-hat assemblies.

The following is a general example as to one embodiment of the invention. One skilled in the art would recognize that there are equivalents or variations as to the type of materials used, variations in size, thickness or length of components or the fact that other components could be added on to change the sound or to modify the sound effect.

Below is one example as to how one may create one embodiment of the invention:

Materials:

1. One piece of wood (or other durable material) approx. 4"-18" in diameter. This can also be in various shapes, including a crescent moon shape. Several large holes drilled around the circumference, with smaller holes drilled in-between the larger holes (e.g. as shown in FIG. 1 large holes labeled D and small holes labeled G). One approx. ½" hole drilled in the middle of the wood or other material. This is the Top Hi-hat 2. One piece of metal (or other durable material), slightly conical (can also be flat or other shape) around the edges approx. 4"-18" diameter. This can also be various shapes, including a crescent moon shape. One approx. ⅛" hole drilled in the middle. Other holes can be drilled for the installation of "add ons" such as shells, plastic, jingles, etc. This is the Bottom Hi-hat.

3. Several feet of approx. ¼" metal or other hard material linked like a chain. This can be cut into segments to create the Primary Chain (see FIG. 1, Part "C").

4. Several feet of approx. 1/16" metal or other hard material linked like a chain, cut into several small segments at about 3, 4, 5, 6, 7, 8, 9 or 10 inches or more in length. This is used to create the Secondary Chain labeled "F" in FIG. 1.

5. Oval (or other shaped) piece (or pieces) of hardwood, plastic, metal, or other hard material. Approx. 6" in length, and approx. 3" in height. This is used as reinforcement material and/or sound effect material. This material can also be treated with a protective layer or layers.

Relationship Between the Components in Embodiment Above:

The linked material (#3) is looped through the holes drilled around the Top Hi-hat (#1). The small linked material (#4) is placed through the smaller holes of the Top Hi-hat (#1) to hold the larger linked material (#3) against the Top Hi-hat (#1). The small linked material (#4) is looped through the larger linked material (#3) and one link is opened using needle-nose pliers to loop through itself. One link of the small linked material (#4) is opened, and another link from the small linked material (#4) is closed on itself using needle-nose pliers. This action secures the larger linked material (#3) to the Top Hi-hat (#1). This process is repeated through each of the larger holes of the Top Hi-hat (#1). The Bottom Hi-hat (#2) is placed on the bottom of a standard hi-hat stand (or other mounting device), placing the existing pole through the ⅛" drilled hole in the center of the Top and Bottom Hi-hats. A standard hi-hat clutch is attached on the Top Hi-hat (#1) through the hole in the middle and is placed on the hi-hat stand. The oval (or other shaped) piece (#5) can be drilled into the edge of the Top Hi-hat (#1) for reinforcement during use. This can also enhance and affect the sound of the instrument when struck with a drumstick, causing a recreation of the well-known "handclap 808" (i.e. Roland "808" or similar) snare drum sound. Various forms of protectant such as, but not limited to, rubber, plastic, or wood may be applied to any part of the device. In another embodiment an impact plate (see E in FIG. 1) may be attached to the Top Hi-hat which offers a variation of the handclap sound.

How the Invention Works:

When the Bottom Hi-hat is placed on the hi-hat stand (or other mounting system), the long pole protrudes through the pre-drilled hole and Bottom Hi-hat is horizontal and stationary. The Top Hi-hat (with pre-attached linked material, oval reinforcement piece, and standard clutch in in pace) is placed on top of the Bottom Hi-hat, through the pole. When the hi-hat pedal is slightly pressed down, the clutch is clamped down to the pole. When the pedal is released, the Top Hi-hat is suspended above the Bottom Hi-hat. The linked material, which have been pre-attached to the Top Hi-hat, hangs down and touch against the inside of the Bottom hi-hat. When the pedal is pressed down, the Top Hi-hat and linked material (i.e. Chain Assemblies) are lowered against the Bottom Hi-hat creating a unique, complex, and desirable sound. The linked material on the Top Hi-hat are loose enough to allow movement against the wood (or other material). When fully closed, either by loosening the clutch or by keeping the hi-hat pedal pressed down, the device can be struck with a drumstick (or other object) to re-create a hand clapping (i.e. Roland "808" or similar) snare drum sound. Striking the device on the top, middle, bottom, or other direction will create a variety of sounds due to the specific items used in the creation of the device. Items other than drumsticks can be used to strike the device to create a variety of sounds due to the specific items used in the creation of the device The round nut on the standard hi-hat clutch is unscrewed from the bottom, and one or both pieces of felt removed. The main top part of the clutch is placed in the middle hole of the top of the Top Hi-hat (#1), and then the felt and round nut are re-attached to the clutch. The clutch is now attached to the Top Hi-hat (#1). After the Bottom Hi-hat (#2) is placed on the hi-hat stand through the long pole, the Top Hi-hat (#1) is placed on the long pole of the standard hi-hat stand, and the clutch clamped down at the desired height.

How to Make One Embodiment of the Invention:

The device is made in two primary parts: 1) The Top Hi-hat is a wooden (or other material) top (could be any shape), and 2) a conical (or flat or other shape) galvanized steel (or other material) bottom. An approx. 0.5" center hole must also be drilled into the Top Hi-hat to allow for the use of any standard hi hat clutch or any mounting device.

The next step is drilling several approx. 1-1.5" holes evenly spaced around the Top Hi-hat (approx. 1.5" away from the edge) and stringing the linked material through the holes; allowing the linked material to hang down several inches underneath. The two loose ends of the linked material must then be connected to itself with either a zip tie (or other material), or by splitting apart one link, and closing it again attached to the other end of the linked material. Two smaller holes are then drilled in the Top Hi-hat in between two of the larger linked material holes at approximately an inch apart so that zip ties, smaller linked material, or similar material can be strung through the linked material and Top Hi-hat to hold the large linked material in place.

The Bottom Hi-hat can be, but is not limited to being, the same size and shape as the Top Hi-hat. An approximate 0.5" center hole must be drilled in the center to allow for use with any standard hi hat stand (or other mounting device). The conical shape allows for the linked material hanging from the Top Hi-hat to drop into the Bottom Hi-hat and contributes to the "handclap 808" (i.e. Roland "808" or similar) snare drum sound.

The only element not necessary are the 1/16" linked material; zip-ties (or other similar material) can be used in place of them. A proprietary design of shells/wood/other material pieces can be used on the top of the Top Hi-hat by attaching to the Primary or Secondary Chains or other linked material to enhance the sound effect as "add-ons." Add-ons could also be attached to the Bottom Hi-hat as well.

The Top Hi-hat and Bottom Hi-hat can be cut into a variety of shapes, to create a closer proximity to the primary hi-hat or to alter the sound. The user can use the Top Hi-hat as a Bottom Hi-hat and visa-versa. The variety of shapes and sizes also provide options for the consumer. The specific size and shape of the device is not limited in any way. A variety of sound effects can be placed on top of or attached to the Top Hi-hat, attached to the Bottom Hi-hat, or in-between the two pieces as "add-ons." Various forms of muffling such as, but not limited to, cloths, rubber, or other sound dampening material, can be used on both the Top Hi-hat and the Bottom Hi-hat to alter the sound quality.

How to Use the Invention:

When a standard hi-hat is played with the drummer's foot, by placing pressure on the hi-hat pedal, the sound is clean, fast, and sonically limited. The claimed device allows the user to create a long and complex "crunchy" sound when the hi-hat pedal is pressed down. The length of the sound is adjustable depending on the distance between the Top Hi-hat and Bottom Hi-hat which can be modified. The pedal is pressed down by the user, and the desired effect is achieved when a standard hi-hat is struck with a drumstick, the sound is clean and traditional. The claimed device replicates the well-known "handclap 808" snare drum/handclap sound when struck with a drumstick or can be modified as described herein, to create other sound effects. The user strikes the device, with the pedal pressed down, with a drumstick to achieve the well-known "handclap 808" (i.e. Roland "808" or similar) snare drum/handclap sound.

That which is claimed:

1. A hi-hat instrument comprising:

a. A Top Hi-hat comprised of wood or wood composite having at least one Chain Assembly wherein said Chain Assembly comprises a Primary Chain passing through a large hole of the Top Hi-hat and a Secondary Chain passing through a small hole of the Top Hi-hat and wherein said Secondary chain attaches to said Primary Chain, and further wherein, said Top Hi-hat comprises an Impact Plate;

b. A Bottom Hi-hat comprised of metal that comes in contact with the Chain Assembly of a.

2. The hi-hat instrument of claim 1, wherein the Impact Plate is comprised of wood or a wood composite.

3. The hi-hat instrument of claim 1, wherein the Top Hi-hat comprises 2 or more Chain Assemblies.

4. The hi-hat instrument of claim 1, wherein the Bottom Hi-hat is composed of tin, aluminum, galvanized steel or a metal alloy.

5. The hi-hat instrument of claim 4, wherein the Bottom Hi-hat comprises an uneven or hammered surface, further wherein said uneven or hammered surface comes in contact with the Chain Assembly.

6. A Top Hi-hat configured to be mounted on a hi-hat mount comprising at least one Chain Assembly, wherein said Chain Assembly comprises a Primary Chain passing through a large hole of the Top Hi-hat and a Secondary Chain passing through a small hole of the Top Hi-hat, wherein said Secondary chain attaches to said Primary Chain, and further wherein the Top Hi-hat comprises an Impact Plate and said Top Hi-hat is made of wood or a wood composite.

7. The Top Hi-hat of claim 6, wherein the Impact Plate is comprised of wood or a wood composite.

8. A hi-hat instrument comprising the Top Hi-hat of claim 6.

* * * * *